US008359966B1

(12) United States Patent
Brotherton

(10) Patent No.: US 8,359,966 B1
(45) Date of Patent: Jan. 29, 2013

(54) AMBIDEXTROUS RIFLE BOLT STOP RELEASE

(76) Inventor: William A. Brotherton, Georgetown, FL (US)

( * ) Notice: Subject to any disclaimer, the term of this patent is extended or adjusted under 35 U.S.C. 154(b) by 0 days.

(21) Appl. No.: 13/278,929

(22) Filed: Oct. 21, 2011

(51) Int. Cl.
*F41A 3/42* (2006.01)

(52) U.S. Cl. ..... 89/181; 89/190; 42/70.02

(58) Field of Classification Search ..... 42/70.01, 42/70.02, 16, 17; 89/181, 137, 153, 190, 89/138, 180
See application file for complete search history.

(56) References Cited

U.S. PATENT DOCUMENTS

| | | | | |
|---|---|---|---|---|
| 5,519,954 | A * | 5/1996 | Garrett | 42/6 |
| 7,661,219 | B1 | 2/2010 | Knight | |
| 8,161,861 | B2 * | 4/2012 | Haley et al. | 89/1.4 |
| 8,261,652 | B2 * | 9/2012 | Findlay | 89/181 |
| 2006/0123683 | A1 * | 6/2006 | Garrett et al. | 42/6 |
| 2010/0251591 | A1 * | 10/2010 | Burt et al. | 42/70.01 |
| 2010/0275485 | A1 | 11/2010 | Findlay | |
| 2011/0056107 | A1 | 3/2011 | Underwood | |
| 2012/0167424 | A1 * | 7/2012 | Gomez | 42/14 |

* cited by examiner

*Primary Examiner* — Jonathan C Weber
(74) *Attorney, Agent, or Firm* — Sven W. Hanson

(57) ABSTRACT

A method of modifying a rifles of the M16, M4, AR15 platform provides a second bolt stop release operable from the right side of the rifle. The second bolt stop release is a rigid extension of the bolt stop that passes through the right receiver wall to a position accessible to a user gripping the rifle with the user's right hand in conventional firing position. The two bolt stop releases provide the inventive rifle ambidextrous bolt release operation.

5 Claims, 3 Drawing Sheets

AMBIDEXTROUS RIFLE BOLT STOP RELEASE

BACKGROUND OF THE INVENTION

The present invention pertains to mechanisms in firearms that control or limit the movement of the firearm "bolt" element. In many typical firearm designs, a magazine is used to store and feed ammunition into a firing chamber. In many manual as well as semi and fully automatic firearms, a bolt moves backward and forward between each shot, propelled by recoil or expanding gas or a recoil spring. When the bolt moves forward, it moves a cartridge from the magazine and pushes it into the chamber. During firing, the bolt blocks and seals the chamber. When the bolt moves back, the spent ammunition casing is removed from the chamber and ejected from the firearm. Typically, after the last round in the magazine is fired, a floor plate of the magazine is pushed upward by spring action to contact and lift a bolt "stop" or "catch" that is mounted within the firearm receiver. In this lifted position, the bolt stop holds the bolt rearward of the magazine to allow viewing of the chamber and for other purposes. After an empty magazine is removed and a full magazine inserted into the firearm, the bolt must be allowed to move forward to chamber a new round of ammunition.

Various rifles known by the designations "M16" or "M4" or "AR15" include a bolt stop that operates in the above manner. These rifles include a bolt stop that is pivotably secured within the rifle receiver and is rotated upward to block forward travel of the rifle bolt as discussed above. After a new full magazine is inserted, the bolt stop is manually rotated downward to allow the bolt to move forward under spring biasing to chamber a round from the magazine. On these firearms, the bolt stop release is located on the left side of the rifle receiver, intended to be operated by the left hand. This configuration is limiting and is often difficult to use with a single hand while aiming the firearm. As well, this configuration is problematic for left-hand use of the firearm. Rifles having similar platforms and sharing the above described bolt stop and release mechanism are for convenience here referred to as M16/M4 rifles.

What is desired is a similar firearm with a bolt stop release that is operable from both sides. Because there are a substantial number of existing firearms using the prior "left side only" release mechanism, it would be valuable to enable simple modification of these firearms to provide ambidextrous stop release operation.

SUMMARY OF THE INVENTION

The invention includes a method of modifying a M16/M4 rifle to provide a second bolt stop release operable from the right side of the rifle. The second bolt stop release is a rigid extension of the bolt stop that passes through the right-side receiver wall to a position accessible to a user gripping the rifle with the user's right hand in conventional firing position. The inventive method includes modification of existing rifle bolt stop, and also replacement with a bolt stop with the inventive configuration.

The invention includes an improved rifle of the M16/M4 configuration with an ambidextrous bolt stop release.

Additional novel aspects and benefits of the invention will be discerned from the following description of particular embodiments and the accompanying figures.

DETAILED DESCRIPTION OF EMBODIMENTS OF THE INVENTION

The operation of the conventional bolt stop and its release function in the M16/M4 rifle is well known and understood. While the rifle bolt is held back by a bolt stop, to allow the bolt to move forward the bolt stop must be rotated downward about a pivot pin and against the bias of a spring.

In the present invention, the bolt stop is modified to enable the present invention, or an inventive replacement bolt stop is provided and assembled with the rifle in place of the original bolt stop. Either method will provide the same result and enable the inventive objectives and functions.

Figure 1A:
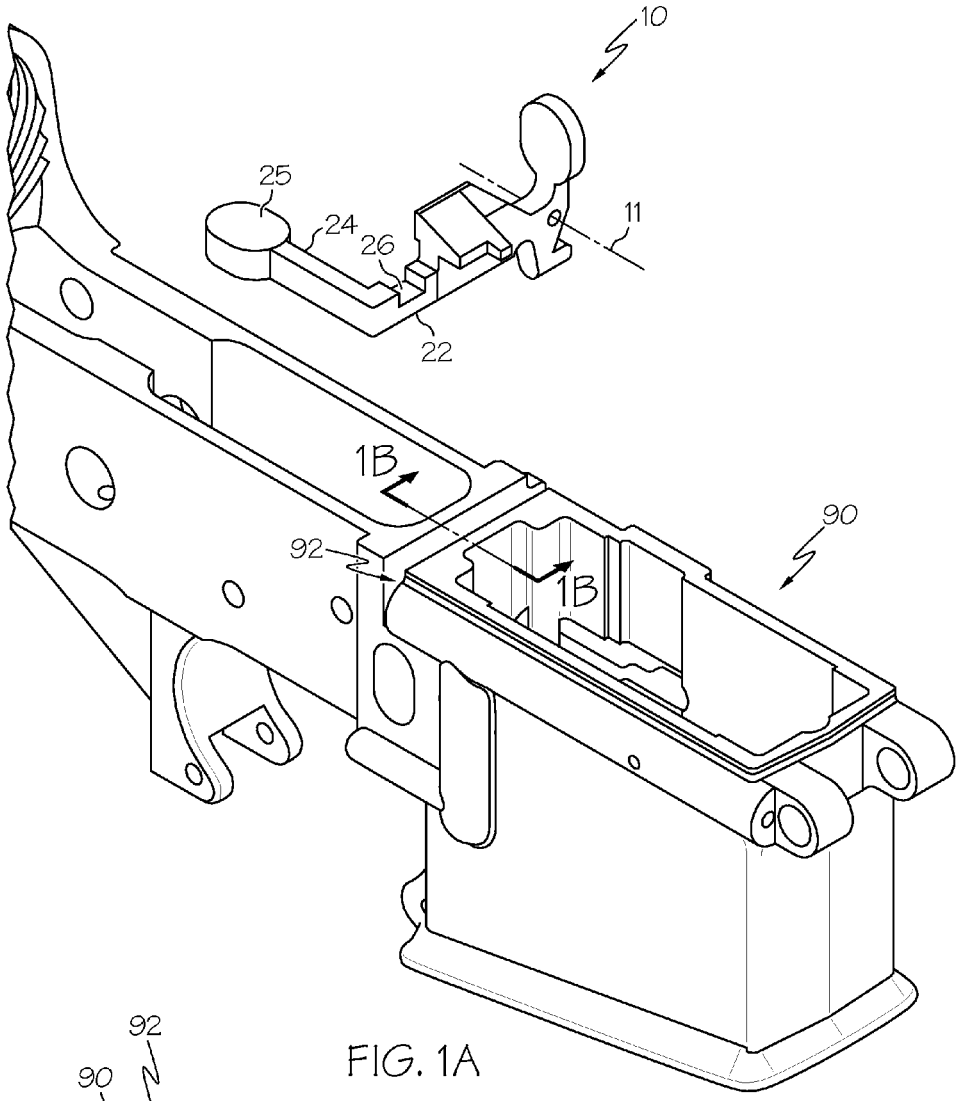
FIG. 1A is a perspective illustration of the inventive rifle receiver and bolt stop.
Figure 1B:
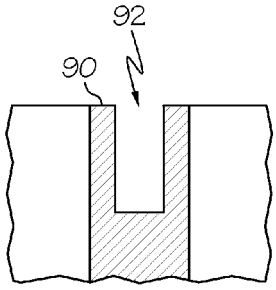
FIG. 1B is a detail section of the embodiment of FIG. 1A.

FIGS. 1A, 1B, 2 and 3 illustrate a rifle receiver and bolt according to the invention. The rifle barrel and various other conventional components have been removed for clarity and simplicity. The elements and configurations shown will be familiar to those skilled in the art with experience with the M16/M4 rifles. FIG. 1A illustrates the inventive bolt stop 10 shown separated from and above a modified rifle receiver lower portion 90 in which the bolt stop 10 is to be mounted according to the invention. The bolt stop 10 includes all of the physical features of a conventional bolt stop. In addition, in the invention, a rigid extension 22 extends laterally, relative to the receiver, and perpendicular to the bolt stop pin axis 11. This extension 22 is long enough such that, when the bolt stop 10 is mounted in the rifle, the extension 22 can protrude through the wall of the receiver lower portion 90 and outside the receiver (this requires modification of the receiver as detailed below). Outside the receiver lower portion 90, an arm 24 extends rigidly substantially perpendicularly from the extension 22 to follow the outside of the receiver lower portion 90. The arm 24 extends rearward to preferably terminate with a relatively enlarged finger pad 25. The finger pad 25 is located, shaped and configured for easy access and operation by a user's right-hand finger while a user is gripping the rifle with the right hand in conventional firing position and attitude. A preferred length of the arm 24 and finger pad 25, from the extension 22 to the distal end of the finger pad 25 is about 1.1 inches. The finger pad 25 itself preferably has a rounded perimeter and serrated contact surface. FIG. 1B clarifies the geometry of the slot 92.

The extension 22, arm 24 and figure pad 25 are all integral and rigidly coextensive with the bolt stop 10. The integrated whole is preferably cast or machined from a single piece of steel of the same specification as a conventional M16/M4 bolt stop. While the extension 22 and arm 24 are described here distinctly, this is only for convenience and the two elements have no inherent boundary and they exist and operate as a single integrated whole. The particular details of the shape of the extension 22 and arm 24 are not critical but may be altered somewhat to satisfy particular user desires in location of actuation of the release.

To enable the extension 22 to pass through the wall of the receiver lower portion 90, the lower portion 90 is modified from the conventional design. Particularly, a slot 92 is cast (in a new original piece) or machined (in a new or retrofitted piece), transversely through the wall of the lower portion 90 aligned with the bolt stop. Preferably the slot 92 extends downward from the upper face surface of the lower portion 90 to provide a slot opening into which the extension may be introduced upon assembly. The slot 92 should be slightly wider than the extension 22 and deep enough for the bolt stop 10 functional movement here defined. In the M16/M4 rifles, the slot 92 may be formed essentially as a transverse continuation of the receiver cavity intended to contain the conventional bolt stop. To retrofit or modify existing receivers, the lower receiver wall may be machined to provide the needed slot 92.

The extension 22 and the slot 92 are together configured so that the rifle upper receiver portion (not shown in FIG. 1A) need not be modified from a conventional configuration to carry-out the invention. For this reason, the extension 22 includes a counterstep 26 with a reduced thickness (height) to fully accommodate the upper receiver during movement of the bolt stop 10. While it is possible to configure a bolt stop with an extension passing through a slot at least partially within the upper receiver portion, such a design is not, generally, as desirable.

Figure 2:
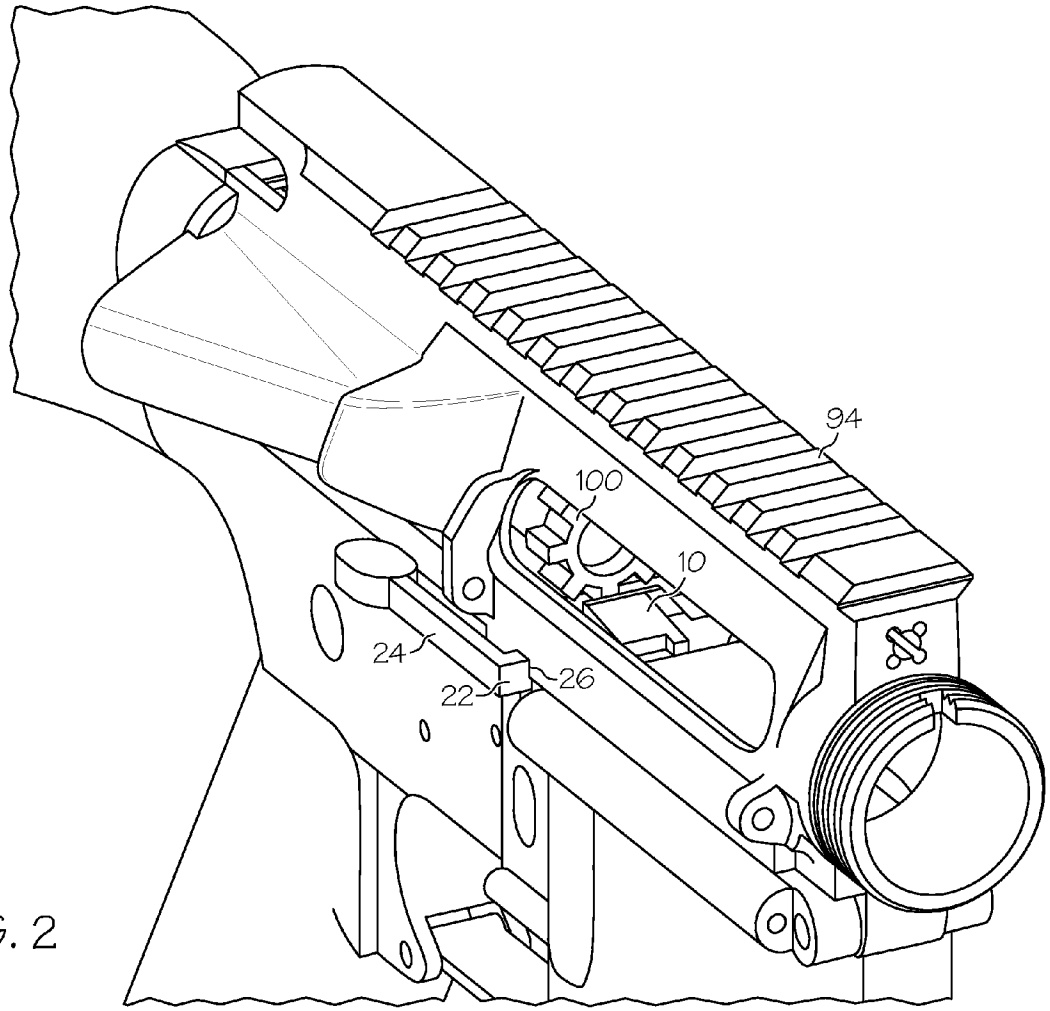
FIGS. 2 and 3 are perspective views of a rifle with the inventive bolt stop and illustrate the two conditions of the inventive bolt stop during its function.
Figure 3:
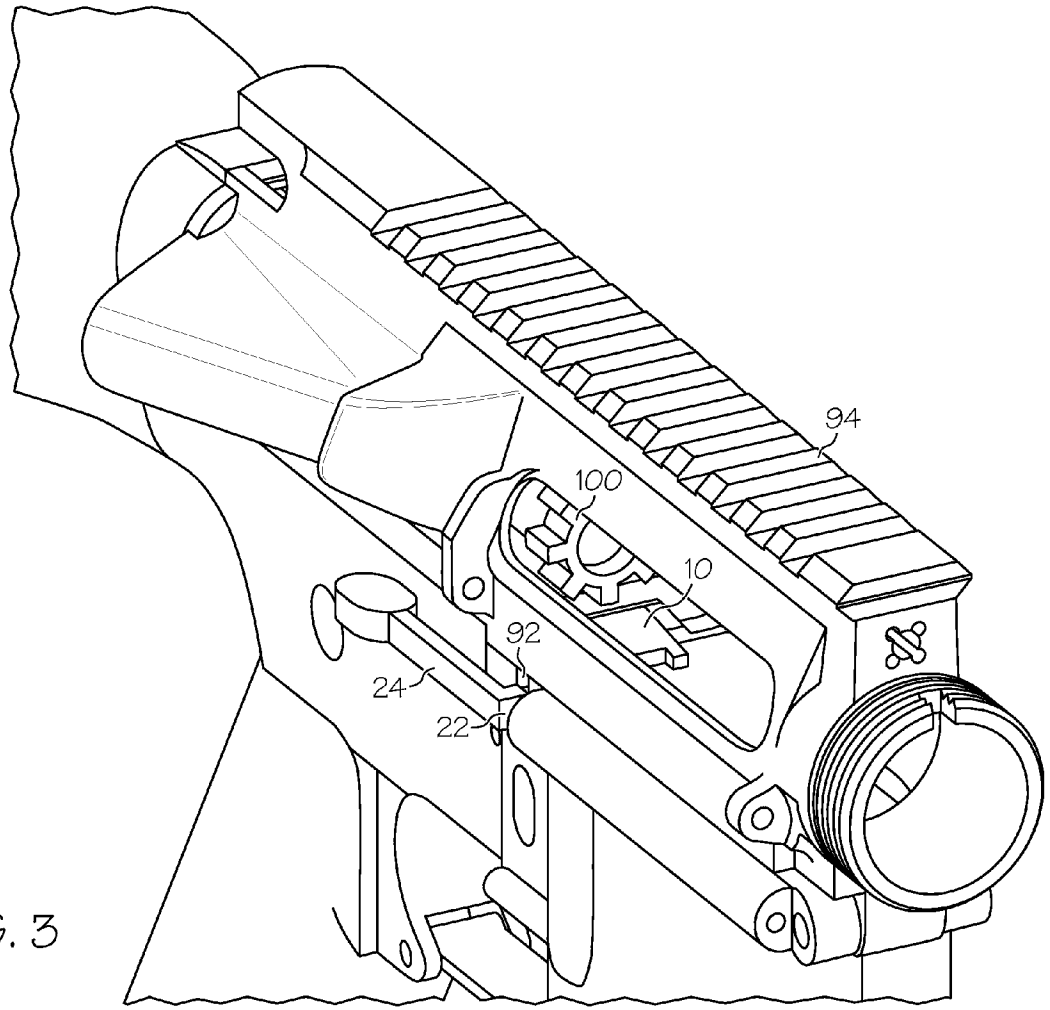

FIGS. 2 and 3 illustrate the two conditions of the bolt stop during its function. The bolt stop 10 is pivotably mounted in the lower portion 90 in conventional manner and location. In FIG. 2, the bolt stop 10 is in an upwardly rotated, raised, position, blocking the bolt 100 in a position rearward of the chamber. The extension 22 and arm 24 are likewise raised (such that the receiver upper portion 94 is received within the counterstep 26 in the configuration shown). In FIG. 3, the extension 22 and arm 24 are rotated relatively downward as the bolt stop 10 is lowered away from the bolt 100. While the bolt 100 is shown in its rearward position, in normal operation in this condition the bolt 100 would immediately travel forward under spring force into the chamber. The inner details of the magazine are not shown (through the upper receiver door) in FIGS. 2 and 3 for clarity.

The elements of the bolt stop 10 that protrude through the receiver, such as to be actuated by the user, are considered here to be a "release" element in that their operation and movement release the bolt 100 from its stopped position and condition. In that regard, the conventional M16/M4 actuator (on the left side of the rifle) is considered a release, as is the combined extension 22 and arm 24 above.

In methods of the invention, a modified bolt stop 10 is mounted in a rifle and the rifle readied for operation in conventional manner. In the event that the bolt 100 is stopped in its rear position by the bolt stop 10 and is desired to be released by a user grasping the rifle in conventional firing manner, the bolt stop 10 may be released by either operating the conventional (left side) release or moving downward the inventive bolt stop release arm 24 on the right side of the rifle. This operation of bolt stop release on the right side of the rifle may be accomplished by movement of a finger of the user's right hand while maintaining conventional firing grip on the rifle. This provides ambidextrous release of the bolt.

Herein, the terms "right" and "left" refer to the relative locations or directions with respect to a user holding an associated rifle in conventional manner for firing. Herein, the term "side" is used respecting a rifle to indicate the orientation or position transverse from the axis of the barrel. Similarly, operations herein respecting "out side" the rifle or rifle receiver regards the facing surfaces and faces of the rifle that are facing outward and transversely to the barrel axis.

The preceding discussion is provided for example only. Other variations of the claimed inventive concepts will be obvious to those skilled in the art. Adaptation or incorporation of known alternative devices and materials, present and future is also contemplated. The intended scope of the invention is defined by the following claims.

The invention claimed is:

1. A method of modifying a rifle bolt stop to enable release from outside both lateral sides of the rifle comprising:

modifying a bolt stop having a first release operable from one outer side of a rifle to include on the bolt stop a second release, such that both the first release and second release are rigidly continuous with the bolt stop; whereby the second release may be operated on the opposing rifle outer side when the bolt stop is installed in the rifle; and modifying a rifle receiver to allow the modified bolt stop to be installed such that both releases protrude through a respective sidewall of the receiver such that the bolt stop is operable from outside both sides of the rifle.

2. A method, according to claim 1, and wherein:

the step of modifying a bolt stop comprises providing a replacement bolt stop having a first release operable from one outer side of a rifle and a second release operable on the opposing rifle outer side when the bolt stop is installed in the rifle.

3. A device for stopping and allowing movement of a rifle bolt, comprising:

a bolt stop pivotably secured inside a rifle receiver the bolt stop including:

a first and second release, each rigidly continuous with the bolt stop and passing through the receiver to extend outside a respective opposing outer side of the receiver; such that the bolt stop may be actuated from both sides of the rifle to allow movement of the rifle bolt.

4. A method of improving a rifle having a pivoting bolt stop with a bolt stop release actuator extending from a first side of a rifle receiver, comprising:

alternatively, one of the steps of:

modifying the bolt stop to add a second bolt stop release rigidly continuous with the bolt stop and configured to be operable from a second receiver side, and providing a bolt stop including a second bolt stop release rigidly continuous with the bolt stop; and wherein the second bolt stop release extends from the bolt stop through the second receiver side opposing the first side;

such that the bolt stop may be released by a user by movement of either the first or second release.

5. An improved rifle, wherein the improvement comprises: the device of claim 3.

* * * * *